United States Patent [19]

Maes

[11] 3,982,739

[45] Sept. 28, 1976

[54] PORTABLE VISE

[76] Inventor: Roger V. Maes, 1223 S. Hutchins St., Lodi, Calif. 95240

[22] Filed: Aug. 1, 1975

[21] Appl. No.: 601,031

[52] U.S. Cl. ..... 269/37; 269/41; 269/43; 269/101; 269/271; 269/287

[51] Int. Cl.[2] ..... B25B 1/20

[58] Field of Search ..... 269/37, 41, 43, 44, 269/95, 101, 240, 287, 221

[56] References Cited

UNITED STATES PATENTS

| | | | |
|---|---|---|---|
| 1,486,158 | 3/1924 | Price | 269/101 |
| 2,228,593 | 1/1941 | Dibble et al. | 269/43 |
| 2,778,258 | 1/1957 | Howe | 269/95 |
| 3,218,059 | 11/1965 | Andrew | 269/271 |
| 3,456,941 | 7/1969 | Beskow | 269/41 |
| 3,718,327 | 2/1973 | Nunez | 269/37 |
| 3,745,638 | 7/1973 | Minera | 269/271 |
| 3,883,128 | 5/1975 | Breese | 269/101 |

*Primary Examiner*—Al Lawrence Smith
*Assistant Examiner*—Robert C. Watson
*Attorney, Agent, or Firm*—George B. White

[57] ABSTRACT

A horizontal base formed by intersecting plates rigidly connected to a vertical base of generally V-shaped cross-section; clamping flanges extended from the respective plates outwardly; a clamp member slidable over the respective flanges to act as backing for a fastening clamp threaded therethrough for holding a work in one of the V-shaped spaced formed by the intersecting plates; means being provided on the plates to hold a pipe or the like against turning in either direction when worked on; an adjusting cam on the horizontal base levels the vise on its support.

11 Claims, 2 Drawing Figures

PORTABLE VISE

BACKGROUND OF THE INVENTION

There are in the prior art several types of portable vise, applicant however is unaware of any prior portable vise which can be clamped securely either on a horizontal or a vertical support and which is capable to accomodate pipes as well as plates and which can be accurately leveled on the support even though the support may not be truly level.

It is the primary object of the invention to provide a versatile and simple vise which can be quickly clamped either on a horizontal or vertical support and which can receive and securely hold in position a pipe at right angles to the support and which will positively resist turning of the pipe or the like in either direction, and which can be easily converted also for holding plates.

DETAILED DESCRIPTION

Figure 1:
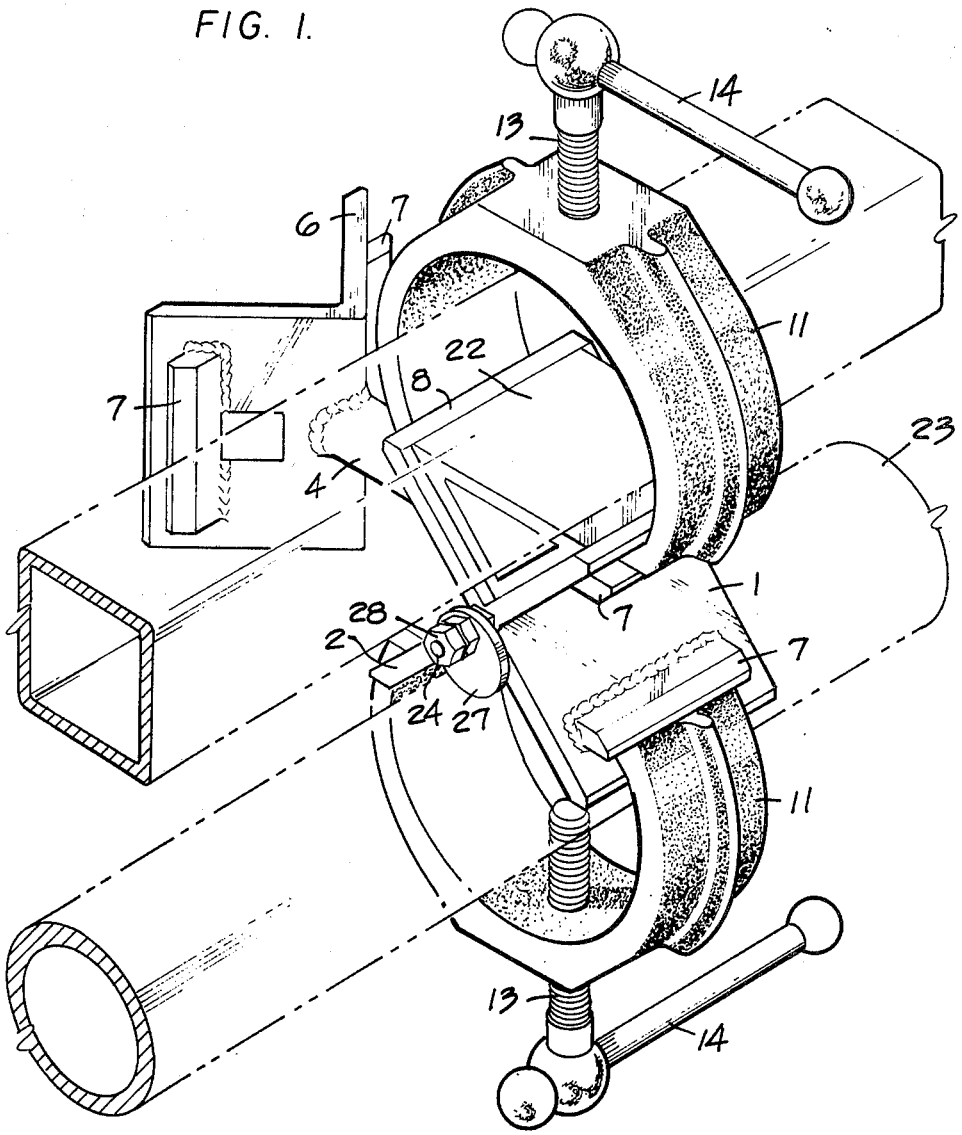
FIG. 1 is a perspective view of the vise mounted on a horizontal bar.

In the herein illustration a horizontal vise is formed by a pair of intersecting plates 1 and 2. The two plates intersect each other at about mid-way of the respective plates so as to form a base substantially in an X-shape cross sectionally. From the middle of the intersection 3 of the plates extends an integral bar 4 on the end of which is integrally supported a vertical base 6 formed by plates in a V-shaped cross section. The open side or well of the vertical base 6 is at right angles to the wells formed in the horizontal base by the plates 1 and 2 and is open away from said intersecting plates 1 and 2.

A projecting flange 7 spaced on the outside from the respective fee edge 8 of each of the plates 1 and 2 extends transversely of the plate. A clamp 11 is cross sectionally curved so that its edges are turned inwardly thereby to be slidable between the free edges of the plates 1 and 2 and the respective flanges 7. Through the middle of the clamp 11 is threaded a set screw 13 of substantial strength. A handlebar 14 on the outer end of the set screw 13 is adapted to apply force for screwing the set screw into and out of the clamp 11 and against a pipe or other work to be clamped in the adjacent well between the plates.

In a longitudinal recess 17 in each plate 1 and 2 adjacent the respective wells is secured a serrated plate 18, the teeth 19 of which are coarse and hardened to grip the pipe or conduit and the teeth 21 of which are finer. These teeth are slanted in alternately opposite directions so as to prevent the turning of a clamped pipe when worked. on.

The vertical base is structurally the same as one-half of the horizontal base would be and has flanges 7, a clamp 11 and set screw 13 of the type heretofore described.

Figure 2:
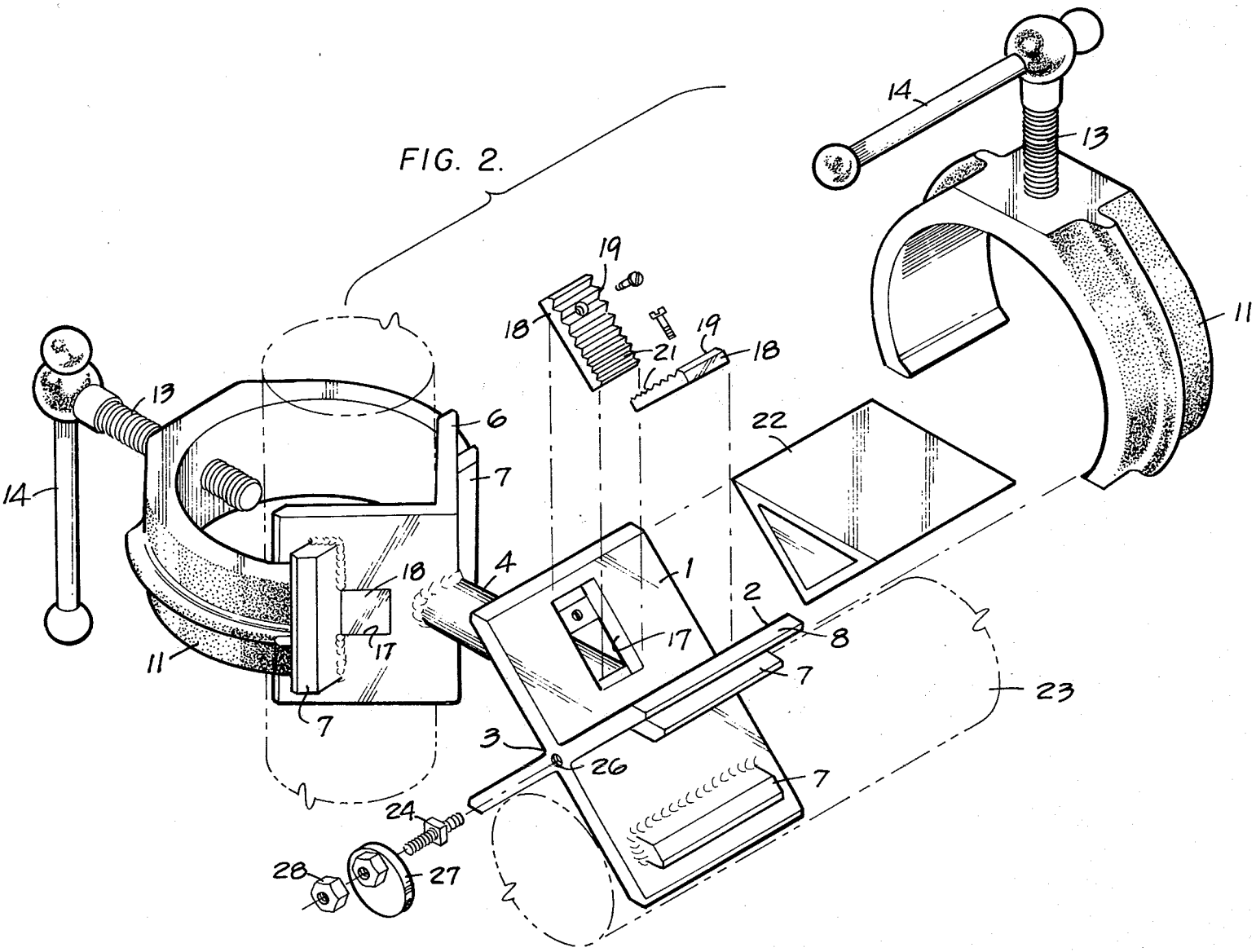
FIG. 2 is a developed view of the vise showing in broken lines the various supports.

The device heretofore described can be carried to the work. For instance, as shown in FIG. 2, its vertical base 6 can be clamped to a post, or a vertical pipe or stanchion in the field near where the work is to be performed. When so secured, the work such as a pipe can be placed into the top well of the horizontal base between the plates 1 and 2 and then clamped into place by the clamp 11 and set screw 13 as heretofore described. This is particularly adapted to welding or cutting at the location of the work instead of carrying the work to a work bench.

A filler 22 of triangular cross-section fits into the top well of the horizontal base. A flat piece of work can be placed on the filler 22 and clamped firmly into position by the set screw 13 in the manner heretofore described.

The horizontal base 1 can also be placed on a horizontal bar 23 by placing the lower well of the horizontal base on a horizontal bar or stanchion. Then the work can be supported horizontally in the top well. In the event the horizontal bar 23 is not exactly at level, the vise can be leveled by means of a screw 24 secured in a threaded hole 26 in an end of the hub of the X-shaped base and an eccentric cam 27 threaded on the screw 24 and held in adjusted position by a nut 28. The cam 27 bears against the bar 23 and when turned it will raise or lower one end of the hub of the X-shaped horizontal base so that the work can be leveled even though the horizontal bar or rail is not exactly horizontal.

The vise heretofore described is portable, it can be carried to the field and it can be easily mounted on any bar, hand rail, or stanchion either horizontal or vertical, and it accomodates the work at its location, hence the work need not be carried to the bench in the shop. The vise can be used to hold a pipe, a flat bar, or an angle iron or the like in a level position while the work is cut or while it is welded or attached to other parts or fittings. The vise is such that one person can perform the necessary operations without the aid of another person for holding the work steady. The vise can be easily detached and made ready to be moved to another location and another work area. The use of this vise is an important time-saver because it makes the work easier on the mechanic who can perform several times more work, more accurately and with less effort. The herein vise has very few pieces, in fact only three parts. One clamp attaches the single vise to a stanchion or pipe and the other holds the piece that is to be worked on. When the screw clamp is tightened on the stanchion or hand rail the piece being worked on is nested in a level or plumb position paralleling the stanchion or hand rail. The device can be used by welders, electricians, pipe fitters, instrument fitters, and the like and in each case it operates positively and efficiently.

I claim:

1. A portable vise comprising a pair of open wells each well being formed by inwardly converging, longitudinal walls and said open wells being united back to back along the inner ends of the converging walls and each well being open at both ends thereof to receive an object lengthwise therein, a single open well formed by inwardly converging longitudinal walls and being open at both ends thereof, means to connect said pair of wells with the single well so as to hold the single well at right angles to and opening away from the pair of united wells whereby said pair of wells form a horizontal support and said single well forms a vertical support of the vise, clamping means engageable with a selected well for clamping the work in said well, and clamping means engageable with another well for clamping said well to a support.

2. The portable vise specified in claim 1, and a joining portion at which said pair of wells are united back to back, and said joining portion being longitudinal with respect to said pair of wells and being horizontal at right angles to said vertical well.

3. The portable vise specified in claim 1, and said walls of said pair of united wells being formed by intersecting members the line of intersection being horizontal relatively to the vertical well.

4. The portable vise specified in claim 1, and slidably engageable coacting elements on the outside of each of said wells and on the respective clamping means for engaging and disengaging said clamping means with the selected well.

5. The portable vise specified in claim 3 and said intersecting members forming a horizontal base of cross-sectionally substantially X-shape.

and said vertical well being formed by sides united in a substantially cross-sectionally V-shape.

6. The portable vise specified in claim 5, and said connecting means being a connecting bar extended from said joining portion of said horizontal base to the outside corner of said V-shaped vertical base.

7. The invention specified in claim 4 and said slidably coacting elements between said clamping means and the outside of said respective well sides including transverse flanges on the outside of the respective sides of said wells, and a clamping member shaped to straddle the open side of the selected well and having edges slidable along the respective flanges.

and an adjustable pressure member in each clamping member movable against the work in said well to press the work into the selected well.

8. The portable vise specified in claim 7 and said movable pressure member being threaded through said slidable clamping member.

9. The portable vise specified in claim 1, and a serrated element on the inside surface of each side of each well, the serrations thereof being arranged in directions to prevent the turning of the work in either direction under the working force thereon.

10. The portable vise specified in claim 3, and adjusting means at the end of said joining portion adapted to bear against a support in the adjacent well and being eccentric for leveling said joining portion in said well relatively to said support.

11. The portable vise specified in claim 3, and adjusting means at one end of said pair of wells for leveling said pair of wells relatively to said support.

* * * * *